US007159676B2

(12) United States Patent
Lyon

(10) Patent No.: US 7,159,676 B2
(45) Date of Patent: Jan. 9, 2007

(54) FLUID DISTRIBUTOR DEVICE FOR DOWN-HOLE-DRILLS

(75) Inventor: Leland H. Lyon, Roanoke, VA (US)

(73) Assignee: Atlas Copco Secoroc AB, Fagersta (SE)

( * ) Notice: Subject to any disclaimer, the term of this patent is extended or adjusted under 35 U.S.C. 154(b) by 164 days.

(21) Appl. No.: 10/495,499

(22) PCT Filed: Nov. 14, 2002

(86) PCT No.: PCT/US02/36768

§ 371 (c)(1),
(2), (4) Date: May 13, 2004

(87) PCT Pub. No.: WO03/042490

PCT Pub. Date: May 22, 2003

(65) Prior Publication Data

US 2005/0034899 A1 Feb. 17, 2005

Related U.S. Application Data

(60) Provisional application No. 60/332,954, filed on Nov. 14, 2001.

(51) Int. Cl.
*E21B 4/14* (2006.01)

(52) U.S. Cl. ..... 175/296; 175/93; 175/414; 175/417

(58) Field of Classification Search ..... 175/19, 175/293, 300, 414, 92, 296, 93, 417; 173/53, 173/200

See application file for complete search history.

(56) References Cited

U.S. PATENT DOCUMENTS

| | | | | |
|---|---|---|---|---|
| 3,078,827 | A | 2/1963 | Oelke et al. | |
| 4,078,619 | A | 3/1978 | Sudnishnikov et al. | |
| 5,141,062 | A * | 8/1992 | Anderson | 175/234 |
| 5,325,926 | A | 7/1994 | Lay et al. | |
| 6,237,704 | B1 * | 5/2001 | Lay | 175/296 |
| 6,637,520 | B1 * | 10/2003 | Purcell | 173/91 |

* cited by examiner

*Primary Examiner*—Kenneth Thompson
(74) *Attorney, Agent, or Firm*—Michael Best & Friedrich LLP

(57) ABSTRACT

A fluid distributor device is for a percussive drill assembly including a generally tubular casing (2) having a longitudinal centerline and a piston (6) disposed within the casing so as to define a reservoir chamber (27) in the casing. The distributor device comprises a generally cylindrical body (12) disposed within the casing and including a central axis, two opposing ends spaced apart along the axis, first and second interior chambers and a port fluidly connecting the two chambers. The body further has a plurality of fluid passages extending between the two ends and fluidly connecting the first chamber with the reservoir chamber and a deflectable retainer portion (16) releasably engaged with the casing so as to retain the body at a desired position with respect to the casing centerline. A valve (7) is disposed within the body and is configured to permit fluid flow through the port and to alternatively prevent fluid flow through the port.

27 Claims, 5 Drawing Sheets

FLUID DISTRIBUTOR DEVICE FOR DOWN-HOLE-DRILLS

RELATED APPLICATIONS

This application is a 371 of PCT/US02/36768, filed Nov. 14, 2002, which claims the benefit of U.S. Provisional Patent Application 60/332,954, filed on Nov. 14, 2001.

BACKGROUND OF THE INVENTION

The present invention relates to drill assemblies, and particularly to components used to direct or distribute operating fluid within drill assemblies having one or more fluid-operated pistons.

One type of commercial drill, commonly referred to as a "down-hole" drill due to its intended application, is typically actuated by high pressure "operating" fluid (e.g., compressed air) that is appropriately directed in order to reciprocate a piston to repetitively impact against a drill bit. These fluid-operated drills may be provided with one of several known systems for supplying and exhausting operating fluid into and out of specific interior fluid chambers used in the operation of the drill. Certain fluid-actuated drills, such as those commercially available from drill manufacturers such as Sandvik, Secoroc and Numa, include a control rod device that interact with holes and ports within the impact piston to deliver and expel air. Other drills, such as those commercially available from Mission, Inc., use ports contained in the outer sleeve or casing of the drill assembly to achieve a similar result.

A third design uses a tubular fluid distributor sleeve or "cylinder" located within the drill outer casing to define a flow path around the operating piston, such as those commercially available from the Ingersoll-Rand Company of New Jersey. More specifically, the distributor cylinder delivers high-pressure air to a first central chamber that supplies air to the interior working chamber(s) of the drill. The cylinder design, while avoiding the shortcomings associated with the need for ports in the piston or casing, does require a means for positioning and supporting the cylinder within the casing.

Precision co-axial alignment requirements, along with holding forces needed to accommodate aggressive shock and vibration loads associated with percussive drilling, requires the supporting and positioning means for the cylinder to be precise, robust and reliable. Axial and radial position must be maintained while holding forces must be large to prevent vibration, movement and resultant wear that could result in misalignment.

Typically, a means for positioning the cylinder within the drill casing employs a separate ring to retain the cylinder at a specified position within the casing, an example of which is also disclosed in U.S. Pat. No. 5,325,926 of Lay et al. Clamping loads applied to the cylinder are transmitted through shoulders on the cylinder, ring and into the casing. The inside shoulder of the ring carries the cylinder load and the outside shoulder of the ring carries the casing load. Such retaining rings typically have a gap to enable the ring to "collapse" or deflect inwardly to enable the ring to be inserted within a recess in the casing. Such a gap can create uneven loading on the retainer ring, which may cause misalignment of the cylinder under load. Additionally, special tooling required for removal and installation of the ring is often cumbersome and reduces the efficiency of service and repair processes.

In view of the above limitations of known cylinder systems, it would be desirable to provide a means for positioning and retaining a fluid cylinder that utilized less components, did not require special tooling to install and remove from a drill casing, was simpler to manufacture and overcame the other inherent limitations of these previously known systems.

SUMMARY OF THE INVENTION

In one aspect, the present invention is a fluid distributor device for a percussive drill assembly, the drill assembly including a generally tubular casing having a longitudinal centerline. The distributor device comprises a generally cylindrical body disposeable within the casing and having a central axis, two opposing ends spaced apart along the axis and at least one fluid passage extending generally between the two ends. A deflectable retainer portion of the body is configured to releasably engage with the casing so as to locate the body at a desired position with respect to the centerline.

In another aspect, the present invention is also a fluid distributor device for a percussive drill assembly, the drill assembly including a generally tubular casing having a longitudinal centerline. The distributor device comprises a generally cylindrical body having first and second interior chambers, a port fluidly connecting the first and second chambers, and a deflectable retainer portion configured to releasably engage with the casing so as to retain the body at a desired position with respect to the casing centerline. A valve is disposed within the body and configured to permit fluid flow through the port and to alternatively prevent fluid flow through the port.

In a further aspect, the present invention is a percussive drill assembly comprising a casing having a longitudinal centerline and an inner circumferential surface. A piston is disposed within the casing such that a piston reservoir chamber is defined generally between the piston and the casing inner surface. A distributor cylinder is disposed within the casing and includes a central axis generally collinear with the casing centerline, two opposing axial ends spaced apart along the axis, first and second interior chambers and a port fluidly connecting the first and second chambers. The cylinder also includes at least one fluid passage extending generally between the two ends and fluidly connecting the first chamber with the reservoir chamber, and a deflectable retainer portion releasably engaged with the casing inner surface so as to retain the body at a desired position with respect to casing centerline. Further, a valve is disposed within the distributor cylinder and is configured to permit fluid flow through the port and to alternatively prevent fluid flow through the port.

BRIEF DESCRIPTION OF THE SEVERAL VIEWS OF THE DRAWINGS

The foregoing summary, as well as the detailed description of the preferred embodiments of the invention, will be better understood when read in conjunction with the appended drawings. For the purpose of illustrating the invention, there is shown in the drawings, which are diagrammatic, embodiments that are presently preferred. It should be understood, however, that the invention is not limited to the precise arrangements and instrumentalities shown. In the drawings.

DETAILED DESCRIPTION OF THE INVENTION

Figure 1:
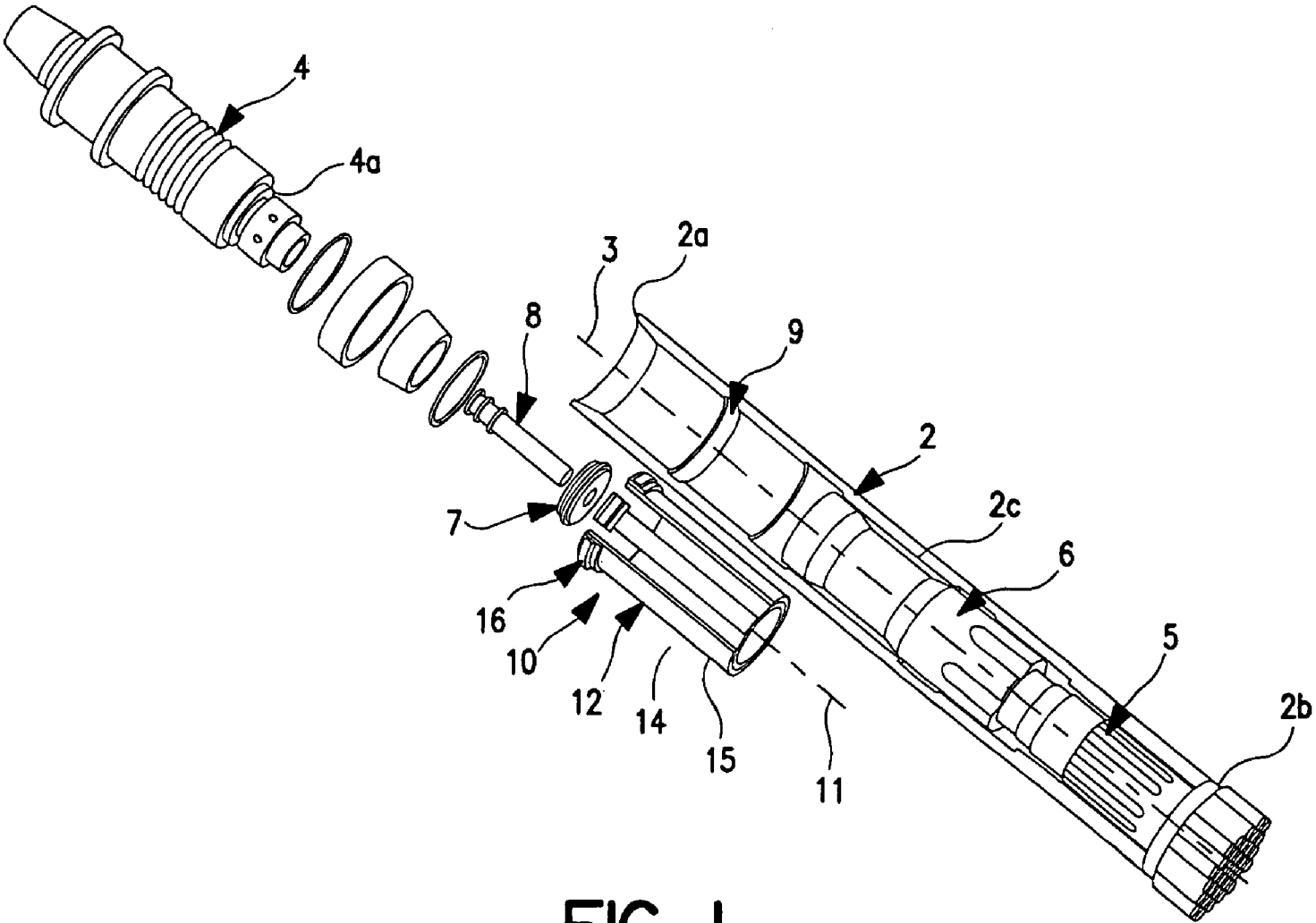
FIG. 1 is exploded view of a percussive drill assembly having a distributor device in accordance with the present invention.

Certain terminology is used in the following description for convenience only and is not limiting. The words "upper", "upward", and "lower", "downward" refer to directions toward and away from, respectively, a designated upper end of a drill assembly. The words "inner", "inward" and "outer", "outward" refer to directions toward and away from, respectively, the geometric center of the drill assembly, the drill centerline or the distributor body central axis, the particular meaning intended being readily apparent from the context of the description. The terms "radial" and "radially-extending" refer to directions generally perpendicular to a designated centerline or axis, and refer both to elements that are either partially or completely oriented in radial direction. The terminology includes the words specifically mentioned above, derivatives thereof, and words or similar import.

Referring now to the drawings in detail, wherein like numbers are used to indicate like elements throughout, there is shown in FIGS. 1–6 a presently preferred embodiment of a fluid distributor device 10 for a fluid-operated percussive drill assembly 1. The drill assembly 1 preferably includes a source of operating fluid A (shown diagrammatically), which is preferably compressed air, a casing 2 having a longitudinal centerline 3 and a piston 6 disposed within the casing 2 such that a piston reservoir chamber 27 is defined generally between the piston 6 and the casing 2. The distributor device 10 basically comprises a generally cylindrical body 12 disposeable within the casing 2 and having a central axis 11 and first and second opposing ends 12*a*, 12*b*, respectively, spaced apart along the axis 11. The body 12 further has at least one fluid passage 14 extending generally between the two ends 12*a*, 12*b* and a deflectable retainer portion 16. The retainer portion 16 is configured to releasably engage with the casing 2 to retain the cylindrical body 12 at a desired position P in the casing 2 with respect to the centerline 3. It must be noted that the desired position P is indicated by the location of a designated center point C of the body 12 to facilitate description of the present invention and the particular reference center point C has been selected for convenience only.

Preferably, the distributor body 12 further has a first and second interior chambers 23, 25, respectively, and a primary port 48 fluidly connecting the first and second chambers 23 and 25. The distributor device 10 preferably further comprises a valve 7 disposed within the body 12 and configured to permit fluid flow through the port 48 and to alternatively prevent fluid flow through the port 48. The first or "supply" chamber 23 is fluidly connectable with the operating fluid source A and the fluid passage 14 fluidly connects the supply chamber 23 with the reservoir chamber 27 when the body 12 is located at the desired position P. As such, the fluid passage 14 enables operating fluid to be channeled to a return chamber 31 (FIG. 2) to cause the piston 6 to linearly displace in an upward, return direction 3*b* along the centerline 3, as discussed in further detail below. Further, the piston 6 preferably has an upper portion 6*a* disposeable within the second or "drive" interior chamber 25 such that when the valve 7 permits fluid flow through the port 48, operating fluid flows from the first, supply chamber 23 to the second or "drive" chamber 25 to cause the piston 6 to linearly displace within the casing 2 in a downward, drive direction 3*a* generally along the casing centerline 3.

Further, the retainer portion 16 is preferably formed as a segmented ring 17 configured to deflect or collapse generally inwardly toward the body central axis 11 and to alternatively expand generally outwardly away from the axis 11. More specifically, the distributor body 12 preferably further includes a generally solid tubular portion 33 and the retainer segmented ring 17 is integrally attached or formed with the tubular portion 33. The segmented ring 17 preferably includes a plurality of slotted openings 18 that divide the retainer portion 16 into a plurality of deflectable, cantilever-like locking arms 20. Each locking arm 20 has a first, inner end attached to the body tubular portion 33 and a second, outer or free end 24 engageable with the casing 2 to retain the body 12 at the desired position P. Most preferably, the locking arms 20 each have a lug 26 that engages with a retainer recess 9 in the casing 2 to removably mount the distributor body 12 within the casing 2, as described more fully below. Each of the above-discussed elements or components of the fluid distributor device 10 is described in further detail below.

Although a detailed description of the drill assembly components is beyond the scope of the present disclosure, certain details are described herein to more clearly disclose the distributor device 10 of the present invention. The distributor device 10 is preferably used with a drill assembly 1 that further includes a backhead 4 attached to an upper end 2*a* of the casing 2 and a bit 5 slidably disposed at least partially within the lower end 2*b* of the casing 2. The piston 6 is slidably disposed within the casing 2 and reciprocates in first and second directions 3*a*, 3*b*, respectively, along the centerline 3. More specifically, the piston upper portion/end 6*a* slides within the drive chamber 25 of the distributor device 10 and the piston lower end 6*b* repetitively impacts against the upper end 5*a* of the bit 5. Also, a guide post 8 is attached to the backhead 4, extends through and centers the valve 7 within the distributor body 12 and has a lower end 8*a* that engages inside the piston 6.

Figure 5:
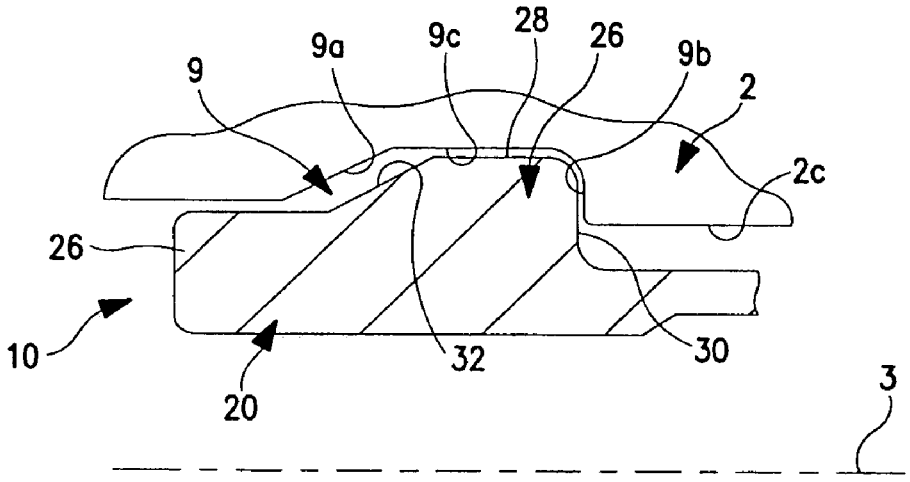
FIG. 5 is a broken-away, greatly enlarged side cross-sectional view of a lug of the distributor device shown engaged with a retainer recess of the casing.

Further, the drill casing 2 preferably further includes an inner circumferential surface 2*c* and a retainer recess 9 configured to engage with the retainer portion 16 of the distributor body 12. Specifically, the retainer portion 16 is engageable with the casing recess 9 to retain the distributor body 12 at the desired position P and alternatively disengageable from the casing recess 9 to permit the body 12 to be displaceable in a direction along the casing centerline 3. Preferably, the retainer recess 9 is generally annular and extends circumferentially into the casing 2 from the inner surface 2*c* and is preferably formed as a single, continuous recess circumscribing the drill centerline 3. Alternatively, the retainer recess 9 may be formed as a plurality of separate arcuate recess sections (not shown) spaced circumferentially about the drill centerline 3. As best shown in FIG. 5, the casing retainer recess 9 preferably includes an upper, lead-in and release surface section 9*a* that is sloped or angled so as to face generally radially-inwardly toward the drill centerline 3, a lower, generally radially-extending or "radial" stop surface section 9*b* and a central inner circumferential surface section 9*c* disposed between the upper and lower surfaces 9*a*, 9*b*, respectively. The three casing recess surfaces/surface sections 9*a*, 9*b* and 9*c* interact with specific surfaces of the distributor retainer portion 16, as described below.

Figure 4:
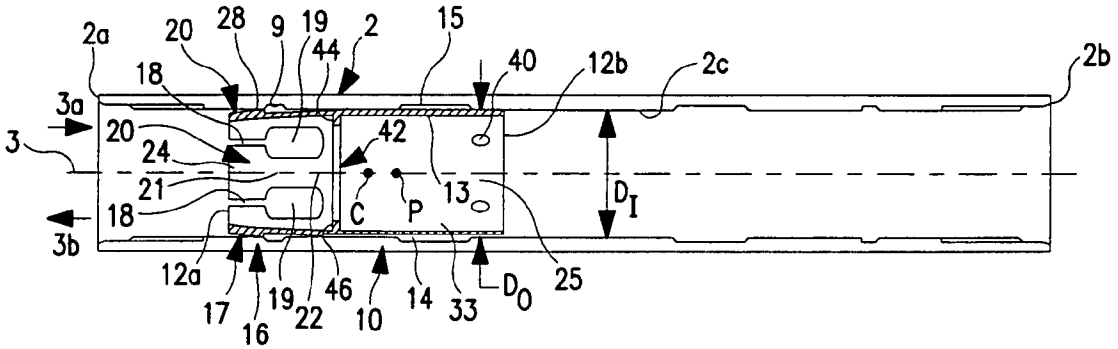
FIG. 4 is a side cross-sectional view of a drill casing and with the distributor device shown spaced axially from an installed position.

Referring now to FIGS. 1–4 and 6, the cylindrical body 12 of the distributor device 10 has inner and outer circumferential surfaces 13, 15, respectively, and is preferably shaped so as to have "axial" cross-sections (i.e., cross-sections perpendicular to and spaced along the axis 11) that are substantially circular. Referring specifically to FIG. 4, the body 12 has an outside diameter $D_O$ that is generally constant along the axis 11, except at the region of the locking lugs 26. The outside diameter $D_O$ of the cylindrical distributor body 12 is sized sufficiently smaller or lesser than an inside diameter $D_I$ of the casing 2 to enable installation of the distributor device 10 into the casing 2, as described in further detail below.

Figure 6:
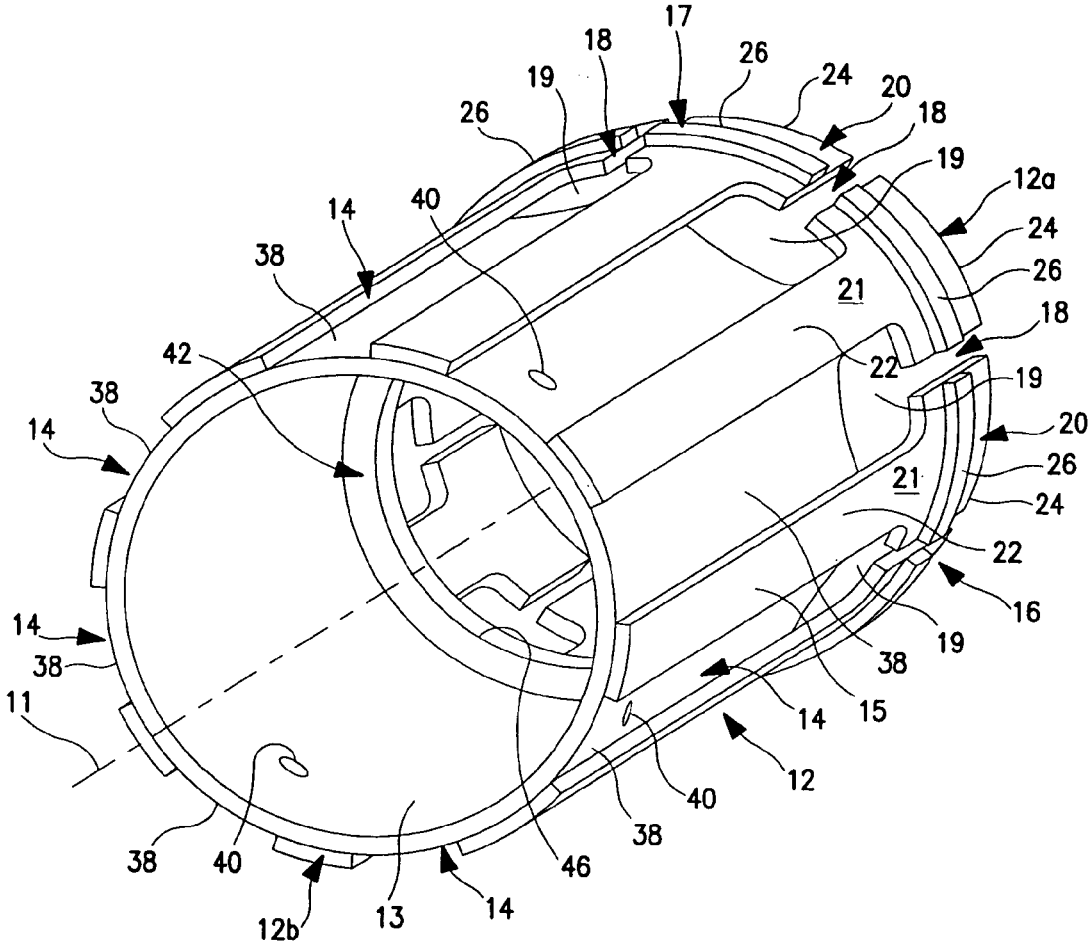
FIG. 6 is an enlarged rear perspective view of a cylindrical body of the distributor of the present invention.

As discussed above, the retainer portion 16 is preferably provided by an integral collapsable ring 17 of the body 12 that is located at the body upper end 12*a*. As best shown in FIG. 6, the slotted openings 18 segment or divide the collapseable ring 17 into eight locking arms 20, which are spaced circumferentially about the central axis 11. As such, when the locking arms 20 engage with the casing 2, as described below, the distributor body 12 is generally centered about the casing centerline 3. Further, each slotted opening 18 extends generally axially and inwardly from the first, upper end 12*a* of the distributor body 12 and enlarges into a fluid port 19. Each fluid port 19 fluidly connects a separate outer fluid passage 14 with the upper supply chamber 23, as discussed in further detail below.

Each locking arm 20 has a first, inner end 22 integrally attached or formed with the solid tubular portion 33 of the cylindrical body 12 and a second, free end 24 located at the body upper end 12*a*. The arms 20 are each "bendable" or configured to bend or deflect at or about the arm first end 22 so as to displace the arm outer end 24 generally toward the body central axis 11 and to alternatively displace the arm outer end 24 generally away from the body axis 11. In other words, the arm outer end 24 is movable between a first, most distal position with respect to the central axis 11 (e.g., FIG. 2) and a second, most proximal position with respect to the axis 11 (e.g., FIG. 4), for reasons described below. Further, each locking arm 20 includes a projection or lug 26 disposed proximal to, preferably spaced inwardly from, the outer, free end 24 of the arm 20 and extending radially outwardly from an outer surface 21 of the arm 20.

Referring particularly to FIG. 5, the locking lugs 26 are each configured to releasably engage with, and are preferably disposable within, the retainer recess 9 of the casing 2 to locate and releasably retain the distributor device 10 at a desired axial position with respect to the drill centerline 3. Preferably, each lug 26 includes an outer circumferential surface section 28, a radially-extending or "radial" stop surface section 30 and an angled or sloped release surface section 32. The three lug surfaces/surface sections 28, 30 and 32 interacting with the surfaces 9*a*, 9*b* and 9*c* of the casing recess 9 in the following manner. Each lug 26 is generally sized such that when the entire retainer portion 16 is engaged with the casing recess 9, the outer circumferential surface 28 of each lug 26 is generally disposed against the inner circumferential surface 9*c* of the casing recess 9, the collective effect of which is to substantially center the distributor body 12 about the drill centerline 3.

Further, when the lugs 26 are disposed in the recess 9, the lug stop surfaces 30 are contactable with the recess stop surface 9*b* to limit axial movement of the distributor body 12 in the first, downward direction 3*a* along the drill centerline 3. Each radially-outwardly facing release surface 32 is contactable with the radially-inwardly facing lead-in/release surface 9*a* of the casing recess 9 to generally limit axial movement in the second, upward direction 3*b* along the drill centerline 3, although the backhead 4 primarily limits distributor body movement in the upward direction 3*b*, preferably through an intermediate elastic member 66. More specifically, an elastic member 66, such as a belleville spring, a compression cone or another appropriate component, is preferably disposed between the backhead 4 and the body 12 and functions both to develop an axial pre-load on the distributor device 10 and to accommodate variations in manufacturing tolerance of the backhead 4 and the body 12. Therefore, during normal operation of the drill assembly 1, the lugs 26 are retained within the recess 9 as the result of contact between the backhead 4 and the body upper end 12*a* (i.e., through the elastic member 66) and by contact between the respective lower stop surfaces 30, 9*c* of the lugs 26 and casing recess 9. The retention of the lugs 26 within the casing recess 9 locates and retains the distributor device 10 at the desired position P with respect to the drill centerline 3.

However, when a sufficient force is applied to the distributor device 10 generally in the second direction 3*b*, the body 12 begins to displace in the second direction 3*a* such that the lug release surfaces 32 slide against the casing lead-in surface 9*a*. The interaction between the angled surfaces 32 and 9*a* deflects the locking arms 20 to bend radially-inwardly about the arm inner ends 24 such that the outer, free ends 26 displace generally inwardly toward the axial centerline 3. The retainer portion 16 of the distributor device 10 thereby becomes inwardly collapsed to release the lugs 26 from the casing recess 9 to slide along the inner circumferential surface 2*c* of the casing 2, as depicted in FIG. 4. The distributor device 10 is then capable of being linearly displaced or slided along the drill centerline 3 in the second, upward direction 3*b* until the body 12 is completely extracted or removed from the casing 2.

Figure 2:
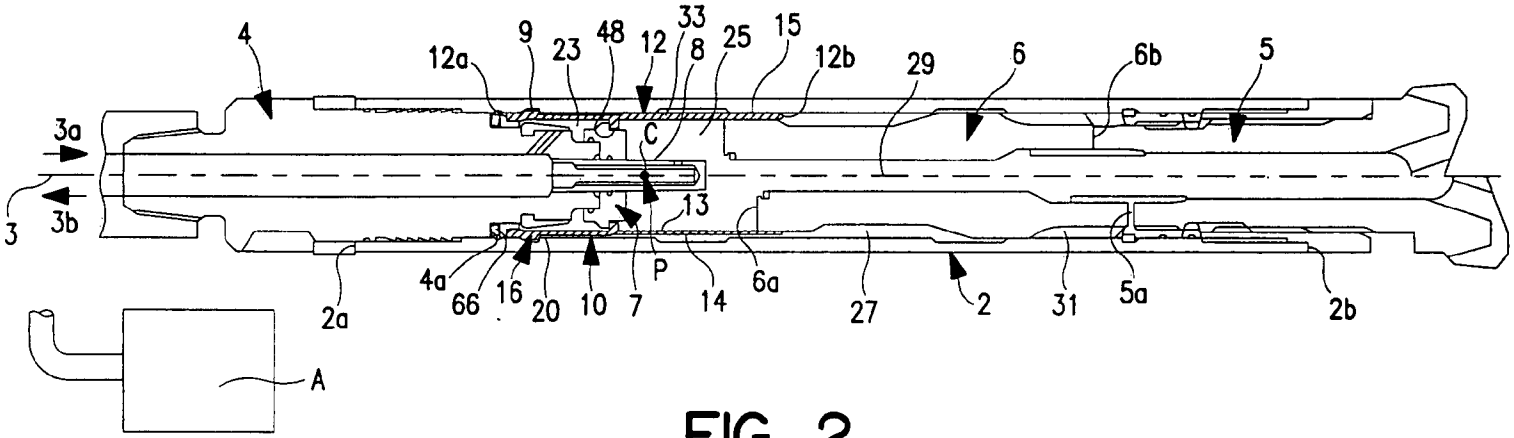
FIG. 2 is a side cross-sectional view of a percussive drill having the distributor cylinder shown in an installed position.

Referring to FIGS. 2 and 6, the distributor body 12 preferably has a plurality of fluid passages 14, most preferably eight passages 14, spaced circumferentially about the body axis 11 and each configured to fluidly connect the first, supply chamber 23 with the piston reservoir chamber 27 during normal drill operation. Each fluid passage 14 is preferably formed as an outer recess 38 extending radially-inwardly into the body 12 from the body outer circumferential surface 15 and generally axially with respect to the central axis 12. Further, each axial recess 38 is generally rectangular-shaped and extends between a separate one of the upper fluid ports 19 and the second end 12*b* of the body 12. When the distributor body 12 is installed in the casing 2, each fluid passage 14 is partially bounded by a proximal section of the casing inner circumferential surface 2*c*. Alternatively, the fluid passages 14 may be provided by axially-extending interior holes or passages (not shown) contained or enclosed within the cylindrical distributor body 12.

As best shown in FIG. 6, four of the preferred eight recesses 38 preferably include a lower fluid "blow" port 40 disposed generally proximal to the second end 12*b* of the body 12 and fluidly connecting the particular recess 38 with the second, drive chamber 25. The blow ports 40 each establish a fluid path from the upper, supply chamber 23, through the associated fluid passage 14, the particular port 40 and the lower, drive chamber 25, into the drill bore passage 29 and out the casing 2, the fluid path functioning to relieve pressure from the drill assembly 1 when the drill 1 is non-operational. Further, the two distributor chambers 23 and 25 are each at least partially bounded by the inner circumferential surface 13 of the body 12 and function to appropriately direct or apply the operating fluid used to operate the drill assembly 1, as discussed above and in further detail below.

Figure 3:
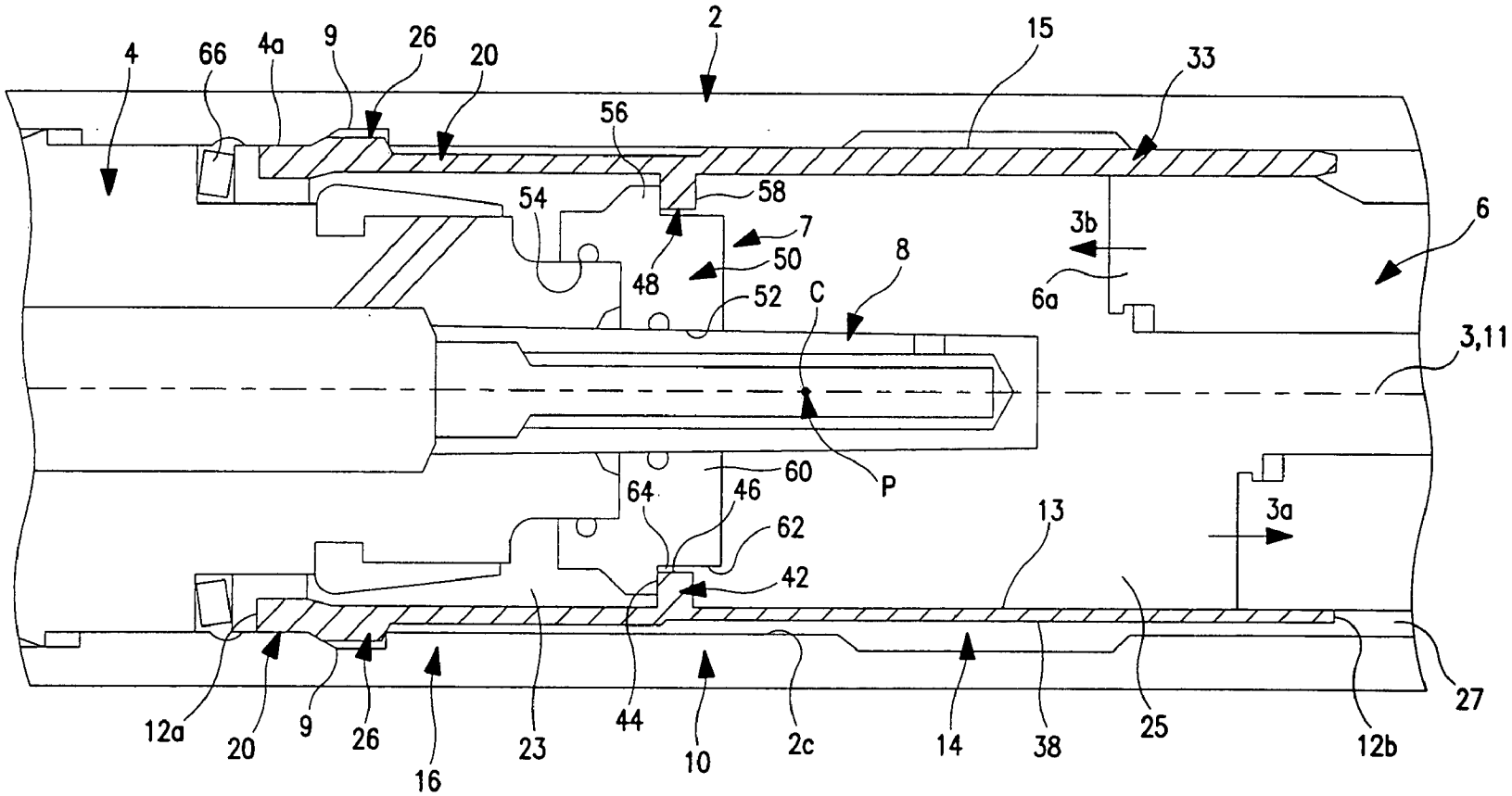
FIG. 3 is a broken-away, enlarged cross-sectional view of the distributor device installed in the casing.

Referring particularly to FIGS. 3, 4 and 6, the distributor body 12 preferably further includes an annular shoulder 42 extending radially inwardly from the body inner surface 13. The annular shoulder 42 preferably extends circumferentially and continuously about the body inner surface 13 so as to circumscribe the central axis 11. Although not preferred, the shoulder 42 may alternatively be provided by two or more arcuate shoulder segments (not show) spaced circumferentially about the body inner surface 13. The shoulder 42 has an inner circumferential surface 46 bounding the primary port 48 and a radially-extending valve seat surface 44 against which the valve 7 is disposeable, as discussed below.

As best shown in FIG. 3, the valve 7 is preferably formed as a generally cylindrical block 50 with a central axial bore 52, the central bore 52 having an enlarged, counterbore portion 54. The valve block 50 includes a radial shoulder portion 56 having a radially-extending, annular contact surface 58 disposeable against the shoulder seat surface 44. Further, the valve block 50 also includes a lower, circular cylindrical portion 60 with an outer circumferential surface 62. The valve lower portion 60 is disposeable within the distributor port 48 and has an outer diameter (not indicated) that is lesser than the inner diameter (not indicated) of the body shoulder 42. As such, an annular fluid passage 64 is formed within the primary port 48 when the valve 7 is assembled in the distributor device 10. More specifically, the annular fluid passage 64 is defined between the shoulder inner surface 46 and the valve outer surface 62 when the valve 7 is slidably disposed on the guide post 8 of the drill assembly 1. Alternatively, the valve 7 may be formed without the lower portion 60, such that the valve contact surface 58 extends completely across the lower end of the valve block 50 and the entire port 48 is used to channel or direct fluid flow between the supply and drive chambers 23 and 25, respectively (structure not shown).

Figure 7:
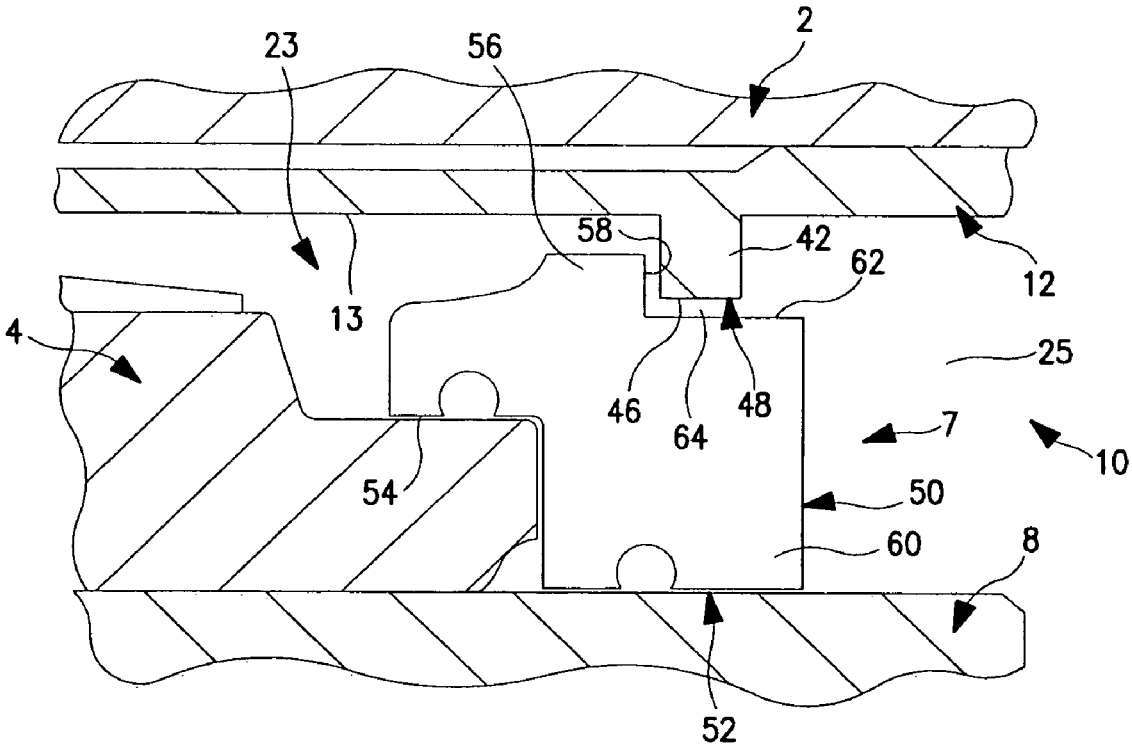
FIG. 7 is a broken-away, greatly enlarged side cross-sectional view of a valve and shoulder of the distributor device showing the valve in an open position.

The valve 7 is displaceable with respect the distributor body 12 between a first position (as shown in FIGS. 3 and 4) and a second position (FIG. 7). In the first position, the valve shoulder surface 58 is disposed against the valve seat surface 44 of the shoulder 42 to substantially prevent fluid flow through the annular fluid passage 64. In the second position (FIG. 7), the valve 7 is spaced axially from the shoulder seat surface 44 in the second direction 3*a* along the drill centerline 3 so as to permit fluid flow through the annular passage 64 within the port 48, and therefore between the supply and drive chambers 23 and 25, respectively. Preferably, the valve 7 moves between the first and second positions by action of the movement of the piston 6 in the second, return direction 3*b*, which compresses operating fluid within the drive chamber 25 such that the compressed fluid forces the valve body 50 to slide upwardly upon the post 8. The opening of the valve 7 permits operating fluid in the supply chamber 23 to flow through the passage 64, into the drive chamber 25 and against the upper end/portion 6*a* of the piston 6, causing the piston 6 to linearly displace within the casing 2 downwardly along the centerline 3 to impact with the bit 5.

Preferably, the distributor body 12 of the present invention is machined from a tube of a hot-rolled metallic material, most preferably 4140 steel, and the valve 7 is machined from a bar of a polymeric material, most preferably acetyl. However, the distributor device 10 of the present invention is not limited to being constructed from any particular type of material and/or fabrication method. For example, the body 12 and/or valve 7 may be made of iron, ceramic or a polymeric material and/or may be made by any appropriate fabrication method, such as for example, casting or forging.

Referring now to FIGS. 1–5, the distributor device 10 is assembled into the casing 2 in the following manner. The second or lower end 12*b* of the cylindrical body 12 is inserted into the upper end 2*a* of the casing 2 and the body 12 is then "pushed" so as to displace along the drill centerline 3 in the first or downward direction 3*a*. The outer circumferential surface 15 of the body 12 slides against the inner circumferential surface 2*c* of the casing 2 until the locking lugs 26 contact the upper end 2*a* of the casing 2. Then, a radially-inwardly directed force is applied to the distributor retainer portion 16 to cause the locking arms 20 to collapse or bend radially-inwardly toward the drill centerline 3 to a collapsed configuration, as depicted in FIG. 4. The locking arms 20 must bend sufficiently to displace the lugs 26 inwardly by an adequate radial distance to enable the lugs 26 to enter the interior of the casing 2 through the casing first end 2*a*.

As shown in FIG. 4, the lug outer surfaces 28 then slide against the casing inner surface 2*c*, along with the remainder of the body outer surface 15, as the body 12 displaces along the axis 3 until the lugs 26 reach the casing recess 9. The lugs 26 then "snap" or displace radially-outwardly into the casing recess 9 (as shown in FIG. 5) by action of elastic material forces stored in each of the bended cantilever-like locking arms 20. The body 12 is then displaced an additional, relatively short distance along the centerline 3 in the first direction 3*b* until the lug radial stop surface 30 contacts the casing radial stop surface 9*b*, such that the distributor device 10 is positioned or located at the desired position P. Next, the elastic member 66 is placed against the first, upper end 12*a* of the body 12 and then the backhead 4 of the drill assembly 1 is attached or threaded onto the upper end 2*a* of the casing 2, such that a downwardly-facing radial surface 4*a* of the backhead 4 compresses the elastic member 66 against the body first end 12*a*. The backhead 4 thereby limits movement of the distributor body 12 in the first or upper direction 3*a* and thus prevents the lugs 26 from sliding out of the casing recess 9.

Thereafter, the distributor device 10 is retained at a specific position on or with respect to the drill centerline 3, with the body central axis 11 being substantially collinear with the centerline 3. The distributor body 12 remains substantially stationary at the desired position P until it is desired to remove the distributor device 10 from the casing 2, which is accomplished by releasing the lugs 26 from the casing recess 9 as described above.

The distributor device 10 of the present invention is clearly advantageous compared with previously known distributor devices, such as those discussed in the Background section of this disclosure. First, the distributor body 12 is retained in a specific position in the casing 2 without the need for additional mounting or retaining components, such as a separate retaining ring or ring segments. Further, the circumferentially spaced lugs 26 contact the casing recess 9 in a manner such that the forces applied by the retainer portion 16 are evenly distributed, thereby preventing any loading imbalance such as occurs with split-ring type retaining devices, as described above. Furthermore, by eliminating the separate ring or ring segments, the need for special tools or fixtures generally required to assemble a cylinder and ring assembly is also eliminated. In addition, the incorporation of the valve 7 into the distributor device 10 eliminates certain valve components required with other fluid distributor systems.

It will be appreciated by those skilled in the art that changes could be made to the embodiments described above without departing from the broad inventive concept thereof. It is understood, therefore, that this invention is not limited to the particular embodiments disclosed, but it is intended to cover all modifications within the spirit and scope of the present invention as described and depicted herein.

I claim:

1. A fluid distributor device for a percussive drill assembly, the drill assembly including a generally tubular casing having a longitudinal centerline, an inner circumferential surface, and a generally annular recess extending circumferentially into the casing from the inner surface, the distributor device comprising:

a generally cylindrical body disposeable within the casing and having a central axis, two opposing ends spaced apart along the axis, at least one fluid passage extending generally between the two ends, and a deflectable retainer portion configured to releasably engage with the casing so as to locate the body at a desired position with respect to the centerline, the retainer portion being engageable with the casing recess to retain the distributor body at the desired position and alternatively disengageable from the casing recess to permit the body to be displaceable in a direction along the casing centerline.

2. The distributor device as recited in claim 1 wherein:

the drill assembly further includes a source of operating fluid and a piston, the piston being disposed within the casing such that a reservoir chamber is defined generally between the piston and the casing; and the body further has an interior supply chamber, the supply chamber being fluidly connectable with the operating fluid source and the fluid passage fluidly connecting the supply chamber and the reservoir chamber when the body is located at the desired position.

3. The distributor device as recited in claim 1 wherein:

the body further has first and second interior chambers and a port fluidly connecting the first and second chambers; and the distributor device further comprises a valve disposed within the body and configured to permit fluid flow through the port and to alternatively prevent fluid flow through the port.

4. The distributor device as recited in claim 3 wherein:

the drill assembly further includes a piston, the piston being disposed within the casing and having a portion disposeable within the body second chamber, and a source of operating fluid connected with the casing; and the body first chamber is fluidly connectable with the operating fluid source such that when the piston portion is disposed within the body second chamber and the valve permits fluid flow through the port, operating fluid flows from the first chamber into the second chamber to cause the piston to linearly displace within the casing in a direction generally along the casing centerline.

5. The distributor device as recited in claim 3 wherein:

the distributor body further has an inner circumferential surface and an annular shoulder extending radially inwardly from the inner surface and circumferentially about the central axis, the shoulder having an inner circumferential surface bounding the port and a radially-extending valve seat surface; and the valve is movable between a first valve position where the valve where the valve is disposed against the seat surface so as to prevent fluid flow through the port and a second valve position is spaced from the seat surface so as to permit fluid flow through the port.

6. The distributor device as recited in claim 5 wherein the drill assembly further includes a backhead having a post, the post being disposed at least partially within the distributor body, the valve being disposeable upon the post so as to slidably displace between the first and second valve positions.

7. The distributor device as recited in claim 1 wherein the retainer portion is formed as a segmented ring configured to collapse generally inwardly toward the body central axis and to alternatively expand generally away from the axis.

8. The distributor device as recited in claim 1 wherein the distributor body further includes a generally solid tubular portion, the retaining portion being integrally formed with the tubular portion and including a plurality of deflectable locking arms, each locking arm having an inner end attached to the tubular portion and an outer, free end engageable with the casing to retain the body at the desired position.

9. The distributor device as recited in claim 8 wherein each locking arm is bendable generally about the arm inner end so as to displace the arm outer end generally toward the body central axis and to alternatively displace the arm outer end generally away from the body axis.

10. The distributor device as recited in claim 8 wherein the plurality of locking arms are spaced circumferentially about the body axis such that when the arms engage with the casing, the distributor body is generally centered about the casing centerline.

11. The distributor device as recited in claim 8 wherein:

the casing further includes an inner circumferential surface and a generally annular recess extending circumferentially into the casing from the inner surface; and each locking arm includes a lug disposed proximal to the arm outer end and disposeable within the casing recess so as to retain the distributor body at the desired position.

12. The distributor device as recited in claim 11 wherein:

the casing recess has a generally radial surface section and an angled surface section; and each lug includes a generally radial surface section contactable with the recess radial surface section when the distributor body is displaced in a first direction along the casing centerline so as to locate the body at the desired position and an angled surface section slidable against the recess angled surface section so as to deflect the arm inwardly toward the central axis when the body is displaced in a second, opposing direction to release the lug from the recess such that the body is further displaceable within the casing in the second direction.

13. The distributor device as recited in claim 1 wherein the distributor body further has an outer circumferential surface and the fluid passage is formed as an outer recess extending into the body from the outer surface and generally axially with respect to the central axis.

14. The distributor device as recited in claim 13 wherein the distributor body has a plurality of the fluid passage recesses spaced circumferentially about the central axis.

15. A fluid distributor device for a percussive drill assembly, the drill assembly including a generally tubular casing having a longitudinal centerline, the distributor device comprising:

a generally cylindrical body having a central axis, two opposing ends spaced apart along the axis and at least one fluid passage extending generally between the two ends, first and second interior chambers, a port fluidly connecting the first and second chambers, and a deflectable retainer portion configured to releasably engage with the casing so as to retain the body at a desired position with respect to the casing centerline a valve disposed within the body and configured to permit fluid flow through the port and to alternatively prevent fluid flow through the port.

16. The distributor device as recited in claim 15 wherein:

the drill assembly further includes a piston disposed within the casing such that a reservoir chamber is defined generally between the piston and the casing; and the fluid passage fluidly connects the first chamber and the reservoir chamber when the body is located at the desired position.

17. The distributor device as recited in claim 15 wherein the distributor body further has an outer circumferential surface and the fluid passage is formed as a recess extending into the body from the outer surface and generally axially with respect to the central axis.

18. The distributor device as recited in claim 17 wherein the distributor body has a plurality of the fluid passage recesses spaced circumferentially about the central axis.

19. The distributor device as recited in claim 15 wherein:

the drill assembly further includes a piston, the piston being disposed within the casing and having a portion disposeable at least partially within the body second chamber, and a source of operating fluid; and the body first chamber is fluidly connectable with the operating fluid source such that when the piston head is disposed within the body second chamber and the valve permits fluid flow through the port, operating fluid flows from the first chamber into the second chamber to cause the piston to linearly displace within the casing in a direction generally along the casing centerline.

20. The distributor device as recited in claim 15 wherein:

the body further has an inner circumferential surface and an annular shoulder extending radially inwardly from the inner surface and circumferentially about the central axis, the shoulder having an inner circumferential surface defining the port and a radially-extending valve seat surface; and the valve is movable between a first valve position where the valve is disposed against the seat surface so as to prevent fluid flow through the port and a second valve position where the valve is spaced from the seat surface so as to permit fluid flow through the port.

21. The distributor device as recited in claim 15 wherein:

the casing further includes an inner circumferential surface and a generally annular recess extending circumferentially into the casing from the inner surface; and the retainer portion is engageable with the casing recess to retain the distributor body at the desired position and alternatively disengageable from the casing recess to permit the body to be displaceable in a direction along the casing centerline.

22. The distributor device as recited in claim 15 wherein the distributor body further includes a generally solid tubular portion, the retaining portion being integrally formed with the tubular portion and including a plurality of deflectable locking arms, each locking arm having an inner end attached to the tubular portion and an outer, free end engageable with the casing to retain the body at the desired position.

23. The distributor device as recited in claim 22 wherein the plurality of locking arms are spaced circumferentially about the body axis such that when the arms engage with the casing, the distributor body is generally centered about the casing centerline.

24. The distributor device as recited in claim 22 wherein:

the casing further includes an inner circumferential surface and a generally annular recess extending circumferentially into the casing from the inner surface; and each locking arm includes a lug disposed proximal to the arm outer end and disposeable within the casing recess so as to retain the distributor body at the desired position.

25. A percussive drill assembly comprising:

a casing having a longitudinal centerline and an inner circumferential surface;

a piston disposed within the casing such that a piston reservoir chamber is defined generally between the piston and the casing inner surface;

a distributor cylinder disposed within the casing and including a central axis generally collinear with the casing centerline, two opposing axial ends spaced apart along the axis, first and second interior chambers, a port fluidly connecting the first and second chambers, at least one fluid passage extending generally between the two ends and fluidly connecting the first chamber with the reservoir chamber, and a deflectable retainer portion releasably engaged with the casing inner surface so as to retain the body at a desired position with respect to casing centerline; and a valve disposed within the distributor cylinder and configured to permit fluid flow through the port and to alternatively prevent fluid flow through the port.

26. A fluid distributor device for a percussive drill assembly, the drill assembly including a generally tubular casing having a longitudinal centerline, the distributor device comprising:

a generally cylindrical body disposeable within the casing and having a central axis, two opposing ends spaced apart along the axis, at least one fluid passage extending generally between the two ends, a deflectable retainer portion configured to releasably engage with the casing so as to locate the body at a desired position with respect to the centerline, and a generally solid tubular portion, the retaining portion being integrally formed with the tubular portion and including a plurality of deflectable locking arms, each locking arm having an inner end attached to the tubular portion and an outer, free end engageable with the casing to retain the body at the desired position.

27. A fluid distributor device for a percussive drill assembly, the drill assembly including a generally tubular casing having a longitudinal centerline, a piston disposed within the casing, and a source of operating fluid, the distributor device comprising:

a generally cylindrical body having first and second interior chambers, the first chamber being fluidly connectable with the operating fluid source and a portion of the piston being disposeable at least partially within the second chamber, a port fluidly connecting the first and second chambers, and a deflectable retainer portion configured to releasably engage with the casing so as to retain the body at a desired position with respect to the casing centerline; and a valve disposed within the body and configured to permit fluid flow through the port and to alternatively prevent fluid flow through the port, such that when the piston head is disposed within the body second chamber and the valve permits fluid flow through the port, operating fluid flows from the first chamber into the second chamber to cause the piston to linearly displace within the casing in a direction generally along the casing centerline.

* * * * *